US011577287B1

(12) United States Patent
Innes et al.

(10) Patent No.: US 11,577,287 B1
(45) Date of Patent: Feb. 14, 2023

(54) LARGE RISER EXTENDED REACH SLUICER AND TOOL CHANGER

(71) Applicant: AGI Engineering, Inc., Stockton, CA (US)

(72) Inventors: Alex G. Innes, Lodi, CA (US); Shon S. Simon, El Dorado Hills, CA (US)

(73) Assignee: AGI Engineering, Inc., Stockton, CA (US)

( * ) Notice: Subject to any disclaimer, the term of this patent is extended or adjusted under 35 U.S.C. 154(b) by 975 days.

(21) Appl. No.: 16/384,519

(22) Filed: Apr. 15, 2019

Related U.S. Application Data

(60) Provisional application No. 62/658,145, filed on Apr. 16, 2018.

(51) Int. Cl.
*B08B 9/093* (2006.01)
*B65D 90/00* (2006.01)

(52) U.S. Cl.
CPC ..... *B08B 9/0933* (2013.01); *B65D 90/0093* (2013.01); *B08B 2209/08* (2013.01)

(58) Field of Classification Search
None
See application file for complete search history.

(56) References Cited

U.S. PATENT DOCUMENTS 1,611,326 A 12/1926 Abbe
2,461,433 A 2/1949 Moulten et al.
2,611,523 A 9/1952 Aines
2,668,825 A 2/1954 Garland
2,669,941 A 2/1954 Stafford
2,682,886 A 7/1954 Paxton
2,761,297 A 9/1956 Buchsteiner
2,819,803 A 1/1958 Obenchain
2,833,422 A 5/1958 Ferwerda et al.
2,985,192 A 5/1961 Taylor et al.
2,999,600 A 9/1961 Gates
3,060,972 A 10/1962 Sheldon
(Continued)

FOREIGN PATENT DOCUMENTS

EP 1166903 1/2002
EP 3151246 A1 4/2017
(Continued)

OTHER PUBLICATIONS

Oceaneering International, Inc., PCT Patent Application No. PCT/US18/060093, filed Nov. 9, 2018, Notification of Transmittal of the International Search Report and The Written Opinion of the International Searching Authority, or the Declaration dated Feb. 5, 2019, 3 pages.

(Continued)

*Primary Examiner* — Mikhail Kornakov
*Assistant Examiner* — Pradhuman Parihar
(74) *Attorney, Agent, or Firm* — Brian S. Steinberger; Hilary F. Steinberger; Law Offices of Brian S. Steinberger, P.A.

(57) ABSTRACT

Extended reach sluicer systems, devices, and methods for breaking up and retrieving chemical, radioactive, hazardous materials and/or other waste and/or other material from storage tanks with mechanical arms and nozzles to break up and transfer tank material. And this invention can work with tanks having high temperature or low temperature conditions.

19 Claims, 12 Drawing Sheets

(56) References Cited

U.S. PATENT DOCUMENTS

| | | | |
|---|---|---|---|
| 3,095,044 | A | 6/1963 | Medlock |
| 3,116,021 | A | 12/1963 | Born |
| 3,155,048 | A | 11/1964 | Mandelbaum et al. |
| 3,161,490 | A | 12/1964 | Dudek |
| 3,162,214 | A | 12/1964 | Bazinet, Jr. |
| 3,190,286 | A | 6/1965 | Stokes |
| 3,266,059 | A | 8/1966 | Stelle |
| 3,274,859 | A | 9/1966 | Tascio |
| 3,305,220 | A | 2/1967 | Nevulis |
| 3,469,712 | A | 9/1969 | Haulotte |
| 3,497,086 | A | 2/1970 | Anderson et al. |
| 3,580,099 | A | 5/1971 | Mosher |
| 3,599,871 | A | 8/1971 | Ruppel |
| 3,757,697 | A | 9/1973 | Phinney |
| 3,788,338 | A | 1/1974 | Burns |
| 3,845,596 | A | 11/1974 | Veenstra |
| 3,863,844 | A | 2/1975 | McMillan |
| 3,889,818 | A | 6/1975 | Wennerstrom |
| 3,932,065 | A | 1/1976 | Ginsberg et al. |
| 3,951,572 | A | 4/1976 | Ray, Jr. et al. |
| 4,106,671 | A | 8/1978 | Sharples |
| 4,132,041 | A | 1/1979 | Van den Broek |
| 4,156,331 | A | 5/1979 | Lester et al. |
| 4,250,933 | A | 2/1981 | Olson |
| 4,339,232 | A | 7/1982 | Campbell |
| 4,393,728 | A | 7/1983 | Larson et al. |
| 4,396,093 | A | 8/1983 | Zimmerman |
| 4,415,297 | A | 11/1983 | Boring |
| 4,494,417 | A | 1/1985 | Larson et al. |
| 4,540,869 | A | 9/1985 | Yasuoka |
| 4,630,741 | A | 12/1986 | Stevens |
| 4,661,039 | A | 4/1987 | Brenholt |
| 4,685,349 | A | 8/1987 | Wada et al. |
| 4,817,653 | A | 4/1989 | Krajicek et al. |
| 4,828,461 | A | 5/1989 | Laempe |
| 4,848,179 | A | 7/1989 | Ubhayakar |
| 4,944,535 | A | 7/1990 | Maupin |
| 4,945,955 | A | 8/1990 | Murphy |
| 4,977,790 | A | 12/1990 | Nishi et al. |
| 5,007,803 | A | 4/1991 | DiVito et al. |
| D326,336 | S | 5/1992 | Christ |
| 5,172,710 | A | 12/1992 | Harrington |
| 5,174,168 | A | 12/1992 | Takagi et al. |
| 5,297,443 | A | 3/1994 | Wentz |
| 5,439,020 | A | 8/1995 | Lockhart |
| 5,451,135 | A | 9/1995 | Schempf et al. |
| 5,515,654 | A | 5/1996 | Anderson |
| 5,518,553 | A | 5/1996 | Moulder |
| 5,540,172 | A | 7/1996 | Goldbach et al. |
| 5,607,000 | A | 3/1997 | Cripe et al. |
| 5,715,852 | A | 2/1998 | Jepsen |
| 5,740,821 | A | 4/1998 | Arnold |
| 5,913,320 | A | 6/1999 | Varrin, Jr. et al. |
| 6,213,135 | B1 | 4/2001 | Moulder |
| 6,264,434 | B1 | 7/2001 | Frank |
| 6,273,790 | B1 | 8/2001 | Neese et al. |
| 6,280,408 | B1 | 8/2001 | Sipin |
| 6,561,368 | B1 | 5/2003 | Sturm, Jr. et al. |
| 6,651,837 | B2 | 11/2003 | Stradinger et al. |
| 6,830,079 | B1 | 12/2004 | Ahrens et al. |
| 6,889,920 | B2 | 5/2005 | Nance et al. |
| 6,938,691 | B2 | 9/2005 | Face |
| 7,021,675 | B2 | 4/2006 | Lawson |
| 7,032,628 | B2 | 4/2006 | Guillemette et al. |
| 7,100,631 | B2 | 9/2006 | Liu et al. |
| 7,241,080 | B2 | 7/2007 | Klobucar et al. |
| 7,708,504 | B2 | 5/2010 | Heckendorn et al. |
| 7,998,251 | B2 | 8/2011 | Pondelick et al. |
| 8,069,747 | B2 | 12/2011 | Buckingham et al. |
| 8,205,522 | B2 | 6/2012 | Buckingham et al. |
| 8,347,563 | B2 | 1/2013 | Anderson |
| 8,414,246 | B2 | 4/2013 | Tobey |
| 8,702,399 | B2 | 4/2014 | Krohn |
| 8,727,671 | B2 | 5/2014 | Sundholm |
| 8,763,855 | B1 | 7/2014 | Harvey et al. |
| 8,840,087 | B2 | 9/2014 | Guyard |
| 9,195,238 | B2 | 11/2015 | Roden et al. |
| 10,280,063 | B2 | 5/2019 | Innes et al. |
| 10,406,571 | B2 | 9/2019 | Innes et al. |
| 2002/0002426 | A1 | 1/2002 | Burkhard |
| 2005/0025573 | A1 | 2/2005 | Waldman et al. |
| 2005/0109376 | A1 | 5/2005 | Gregory |
| 2005/0166413 | A1 | 8/2005 | Crampton |
| 2006/0054189 | A1 | 3/2006 | Luke et al. |
| 2006/0054202 | A1 | 3/2006 | Luke et al. |
| 2008/0023050 | A1* | 1/2008 | Hancock ..... B08B 9/0933 134/115 R |
| 2008/0148876 | A1 | 6/2008 | Hock et al. |
| 2010/0221125 | A1 | 9/2010 | Fulkerson et al. |
| 2010/0234988 | A1 | 9/2010 | Buckingham et al. |
| 2010/0264013 | A1 | 10/2010 | Burton |
| 2011/0186657 | A1 | 8/2011 | Haviland |
| 2011/0315165 | A1 | 12/2011 | McWhorter |
| 2012/0106882 | A1 | 5/2012 | Ponnouradjou et al. |
| 2012/0279537 | A1 | 11/2012 | Peeters et al. |
| 2014/0079573 | A1 | 3/2014 | Pabst |
| 2015/0034176 | A1 | 2/2015 | Garcia Arguelles et al. |
| 2015/0124242 | A1 | 5/2015 | Pierce et al. |
| 2015/0362000 | A1 | 12/2015 | Schmidt et al. |
| 2016/0055268 | A1 | 2/2016 | Bell et al. |
| 2016/0107207 | A1 | 4/2016 | Desormeaux |
| 2017/0173617 | A1 | 6/2017 | Zilai et al. |
| 2017/0259309 | A1* | 9/2017 | Innes ..... B05B 13/0636 |

FOREIGN PATENT DOCUMENTS

| | | | |
|---|---|---|---|
| IN | 201741036558 | A | 10/2017 |
| JP | 2004301665 | A | 10/2004 |
| WO | 2009018599 | | 2/2009 |
| WO | 2014019852 | A1 | 2/2014 |

OTHER PUBLICATIONS

Innes, Alex. G., PCT Patent Application No. PCT/US19/036567, filed Jun. 11, 2019, Notification of Transmittal of the International Search Report and the Written Opinion of the International Search Authority, or the Declaration dated Sep. 17, 2019, 7 pages.

Lane, et al. "FY10 Engineering Innovations, Research and Technology Report" In: Lawrence Livermore National Lab. Jan. 31, 2011 (Jan. 31, 2011) Retrieved on Aug. 10, 2019 (Aug. 10, 2019) from https://e-reports-ext.llnl.gov/pdf/461932.pdf, 99 pages.

Pearson, M.J., et al., "Biomimetic Vibrissal Sensing for Robots," Philosophical Transactions of the Royal Society B (2011), vol. 366, pp. 3085-3096, 12 pages.

Innes, Alex. G., PCT Patent Application No. PCT/US/19/068,359, filed Dec. 23, 2019, Notification of Transmittal of the International Search Report and the Written Opinion of the international Search Authority, or the Declaration dated Feb. 25, 2020, 14 pages.

Bullseye Pumps, Bullseye B200-SPDK Vacuum Loading Solids Pump, 2017, retrieved from http://www.bullseyepumps.com/products/bullseye-b200-spdk-vacuum-loading-solids-pump?variant=31478670788. 10 pages.

Sykes Pumps, General Purpose, GP50 Pump Performance, 2017, retrieved from http://www.sykespumps.com.sa/pumps/products/product-specs/gp_50_75.html. 2 pages.

Pentair Southern Cross, SX60 Portable Slurry Pump, 2017, retrieved from http://www.southerncross.pentair.com.au/product/market/pumps/vacuum-pumps/sx60-portable-slurry-pump/, 3 pages.

Wastecorp. Pumps, Super Duty, TVP-65 Series Vacuum Pumps, 2017, brochure, 1 page.

RITCHIESpecs, Gradall 534D-9-45 Telescopic Forklift, 2017, retrieved from www.ritchiespecs.com, 2 pages.

Boom, Gradall Material Handler 534 D-6/534 D-6 Turbo, Jul. 2002, 1 page.

Manitowoc, National Crane 800H Series Product Guide, 2012, 16 pages.

Manitowoc, National Crane 680H-TM, Aug. 2015, 4 pages.

Festo, Bionic Handling Assistant, Apr. 2012, 6 pages.

(56) References Cited

OTHER PUBLICATIONS

Schutz, Maxon Motor, Robotic Snake-Arm Flies into Tight Spaces, 2012. 4 pages.
McMahan, W., et al., Field Trials and Testing on the OctArm Continuum Manipulator, IEEE, May 2006, pp. 2336-2341, 6 pages.
Li, Z., et al., A Novel Tele-Operated Flexible Robot Targeted for Minimally Invasive Robotic Surgery, Engineering Research Robotics Article, Mar. 2015, pp. 073-078, vol. 1, issue 1, 6 pages.
Li, Z., et al., Kinematic Comparison of Surgical Tendon-Driven Manipulators and Concentric Tube Manipulators, Mechanism and Machine Theory, 2017, pp. 148-165, vol. 107, 18 pages.
Military Elevation Solutions and Tactical Trailers, KVL and KVR Telescopic Cable-Drive Masts, Seo, 2016, 3 pages.
OCRobotics, Laser Snake 2, Snake-arm robot and high-power laser integration, www.ocrobotics.com, 2016, 4 pages.
OCRobotics, Nuclear decommissioning case-study: Laser Snake, Snake-arm robot and high-power laser integration, www.ocrobotics.com, 2016, 4 pages.
Bauer, et al., Development and Deployment of the Extended Reach Sluicing System (ERSS) for Retrieval of Hanford Single Shell Tank Waste—14206 (Draft). U.S. Department of Energy, Assistand Sevretary for Environmental Management, Washington River Protection Solutions, Nov. 2013, 19 pages.
Innes, PCT Patent Application No. PCT/US17/18120 filed Feb. 16, 2017, Notification of Transmittal of the International Search Report and the Written Opinion of the International Searching Authority, or the Declaration dated May 10, 2017, 14 pages.
Innes, PCT Patent Application No. PCT/US17/18120 filed Feb. 16, 2017, Notification Concerning Transmittal of International Preliminary Report on Patentability, 12 pages.

* cited by examiner

LARGE RISER EXTENDED REACH SLUICER AND TOOL CHANGER

CROSS REFERENCE TO RELATED APPLICATIONS

This application claims the benefit of priority to U.S. Provisional Application Ser. No. 62/658,145 filed Apr. 16, 2018, the entire disclosure which is incorporated by reference in its' entirety.

FIELD OF INVENTION

This invention relates to breaking up and retrieving chemical, radioactive, hazardous and/or other waste and/or material from storage tanks, and in particular to extended reach sluicer systems, devices, and methods for breaking up and retrieving chemical, radioactive, hazardous materials and/or other waste and/or other material from storage tanks with mechanical arms and nozzles to break up and transfer tank material, and this invention can work with tanks having high temperature or low temperature conditions.

BACKGROUND AND PRIOR ART

At nuclear waste storage facilities, radioactive material is stored in underground tanks that can be up to 75 feet in diameter. Historically, typical storage tanks are cleaned using remotely operated arms with lengths that allow installation so that when installed, the end effector sits just above the waste depth. From this position the arm can be manipulated to clean the tank. However, because of vary waste depth heights, these systems lack the reach to clean the entire tank area from a single location.

Multiple machines can be strategically placed around the tank perimeter to clean the entirety of the tank. However, this is an inefficient undertaking with extensive operational costs. Also, these lengths limit the capability to clean obstructed areas.

A longer arm cleaning system can effectively position the end effector from the center or any off-center riser of the tank. However, waste depth in some tanks can be too high to allow an arm cleaning system of adequate length to be installed.

An additional problem with typical cleaning systems is end effector failure. Since the end effectors are closest to the radioactive waste, and see the most operation, they can succumb to premature failure while the rest of the arm is still fully functional. It is far too expensive with far too much liability to remove the entire machine for repairs. Therefore, the entire machine is rendered inoperable with these types of failures.

Furthermore, typical equipment only allows for single functionality in a catch all capacity, breaking up waste. Waste in tanks can vary in type and consistency where different methodologies are essential for optimal performance. Multiple machines can be used in a single tank, but this increases operational costs. This singular functionality also does not allow the opportunity to perform other functions in the tank such as collecting samples, or some other work other than cleaning that require specialized end effectors.

Thus, the need exists for solutions to the above problems with the prior art.

The present invention seeks to provide a solution that solves the above challenges and provides means to greatly reduce the amount of waste left in the tank.

SUMMARY OF THE INVENTION

A primary objective of the present invention is to provide a cleaning system, device and method for use in nuclear waste storage tanks that can reach the entirety of the tank at varying waste depths from a central or any off-center location in tanks up to approximately 75 feet in diameter. A plurality of inventions can be located in the tank at varying locations to improve efficiency.

A secondary objective of the present invention is to provide a large riser extended reach sluicer, system, device and method, with tool changing capability to allow varying end effectors to be employed by a single tool improving efficiency. This also allows the end effector to be replaced if it becomes inoperable.

The large riser extended reach sluicer can be installed into existing risers and holes down to approximately 34 inches in diameter from where the telescopic mast extends downward to an appropriate elevation above the waste. The telescopic feature also allows the mast to adjust to varying riser lengths inside the waste tank. The mast can also rotate +/− approximately 180 degrees about the longitudinal axis. From there, the boom can rotate down from the 12 o'clock position 180 degrees to the 6 o'clock position. The boom can then telescope to extend up to approximately 37 and approximately ½ feet.

At the distal end of the mast, a sump tank can house a pump and acts as the sump to collect waste that can then be transferred to remote locations. A tangential inlet flow allows entrained air to be separated as it enters the tank.

The sump design can create the appropriate inlet velocity at the pump that entrains solids into the waste stream. The tank can be vertically adjusted independent of the upper mast as the waste depth diminishes, thus reducing the required suction head pressure required to deliver waste from below.

The pump can be removable through the mast for maintenance and/or replacement. The pump to tank interface prevents waste from overfilling up into the mast and beyond. The tank bottom can swing open to clear debris and allow back flushing of the pump.

The large riser extended reach sluicer can be capable of employing multiple cleaning methods through the use of quick change end effectors. Additionally, with the ability to swap out end effectors, other work functions such as sample collection can be accomplished with a single machine.

Each individual end effector can be stored in a storage container that shields against radiation exposure. On the end of each end effector is a quick disconnect plate that connects to a mating plate on the distal end of the boom. The connections provide circuits for hydraulics, high pressure/low flow water, low pressure/high flow water, supernate, and a suction line for waste conveyance. Locating pins ensure proper alignment between the quick disconnect plate and end effector, and compliance is built in to allow for minor misalignment during initial engagement.

A failsafe mechanism prevents accidental separation of the end effector from the arm. If the end effector becomes inoperable, or a new method is required, the boom can rotate into the 12 o'clock position and extend up through the riser into the tool changer containment area where an end effector storage container awaits.

To reduce environmental exposure, a wash station rinses the radioactive waste from the end effector prior to entering the containment area. Once the fouled end effector is secured in the container, the boom lowers, a door separating the containment area from the tank closes, and the container is lifted and taken away for further processing. A new end effector container can then be lowered into place, the door opened, the boom extended, and a new end effector is engaged and commissioned.

A preferred embodiment of a large riser extended reach sluicer and tool changer can include a vertically adjustable upper mast section that mounts to existing riser structures of a waste tank as small as approximately 34 inches in diameter, and a movable cleaning boom arm having one end attached to the mast section and an opposite end with a changeable end effector.

The large riser extended reach sluicer and tool changer can include a plurality of hose management systems that accommodate axial and radial motion of the arm.

The mast section can include a plurality of hydraulically actuated cylinders and motors allowing operation in hazardous and explosive environments.

The mast section can include a mast assembly attached to a turntable that rotates the arm +/− approximately 180 degrees.

The moveable boom arm can include a telescoping boom that pivots approximately 180 degrees from vertical to horizontal and extends beyond approximately 37 and ½ feet.

The moveable boom arm can include a telescoping boom that when in an approximate 12 o'clock position is extendable up through the riser and stow an end effector in a storage container.

The moveable boom arm can include a telescoping boom that when in an approximate 12 o'clock position is extendable up through the riser and pick an end effector from a storage container to be commissioned in the waste tank.

The large riser extended reach sluicer and tool changer can include one or more sliding gates at a containment interface of the end effector to shield the environment from radiation.

The large riser extended reach sluicer and tool changer can include a wash station prior to the sliding gates at the containment area interface.

The large riser extended reach sluicer and tool changer can include a quick disconnect plate mounted at a distal end of the boom arm with the ability to mate with and support varying end effectors for use in the waste tank.

The large riser extended reach sluicer and tool changer can include a quick disconnect plate with circuits for hydraulics, high pressure and low flow water, low pressure and high flow water, supernate, and a suction line for waste conveyance as needed by varying end effectors.

The large riser extended reach sluicer and tool changer can include a failsafe that includes a quick disconnect plate with hydraulically actuated clamps where pressure applied disengages the clamps so that if pressure is lost, or a hose is damaged, the end effector remains secured to a plate such that the end effector cannot become separated from the boom arm and dropped into the waste tank.

The large riser extended reach sluicer and tool changer can include a container for housing radioactive end effectors and which prevents radiation from leaking into the environment.

The large riser extended reach sluicer and tool changer can include nickel plating on wetted mechanical structures in the changer to counteract corrosive environments.

The large riser extended reach sluicer and tool changer can include a total service weight that is able to be supported by a tank dome and riser structure;

a capability to clean inside, behind, on top, below and around obstructions in tanks, a number of degrees of freedom up to 5 or more, operable capability during the course of a tank cleaning campaign without the need for service, and an extended reach to allow the end effector to get closer to the work surface over a larger area.

The large riser extended reach sluicer and tool changer can include a manifold system for a supply/return of working hydraulic fluid utilizing adjustable electro-hydraulic valves allowing control of the system from up to approximately 1000 feet away.

The large riser extended reach sluicer and tool changer can further comprise a nuclear waste pump system on the distal end of the upper mast.

The nuclear waste pump system can include a submersible pump assembly that fits through an upper mast; and a hydraulically driven pump motor for high power density and for safe operation in areas in the tank with hazardous/explosive vapors, a level indicator, wetted parts constructed of stainless steel to allow for decontamination, a hydraulic power unit with displacement limiting features to keep system pressures in a safe operating range, one or more seals that prevent the waste stream from contaminating the hydraulic fluid, one or more seals with recirculating barrier fluid that is cooled through a heat exchanger comprised of a helical path traversing the outside diameter of the discharge piping, an accumulator to compensate for changes in barrier fluid pressure and temperature, and a sump tank housing the pump mounted at the distal end of a telescoping mast.

The sump tank housing can include one of a conical seat to allow self-alignment of the pump during installation through the mast, and a conical pump seat that creates a seal to prevent waste material from overfilling into and through the mast.

The sump tank housing can include one of a sump tank with a tangential inlet to allow for air separation, and a sump tank with an outlet port to allow for mist recirculation such that no mist is discharged into the waste tank that would compromise visibility.

The sump tank housing can include a sump tank with a hydraulically actuated door at the bottom to clear debris and allow back flushing of the pump.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

FIG. 2C is a close-up view of the process hose and hose reel of FIG. 2B.

DESCRIPTION OF THE PREFERRED EMBODIMENTS

Figure 1:
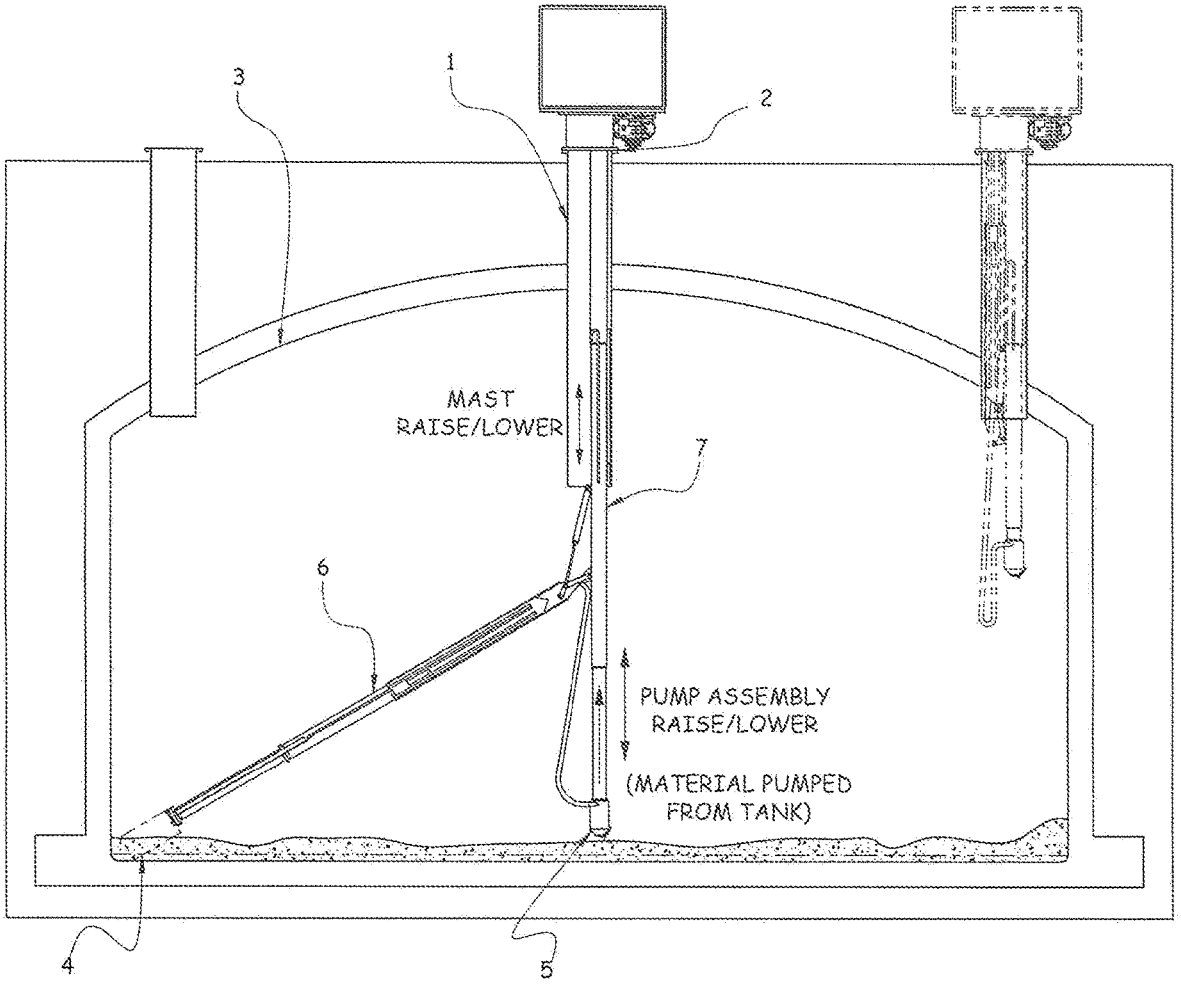
FIG. 1 illustrates a large riser extended reach sluicer and tool changer mounted in a nuclear storage tank with optional auxiliary tool in a possible off-center location.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1 Large riser extended reach sluicer and tool changer
2 Adapter spool
3 Nuclear waste storage tanks
4 End effector
5 Pump assembly
6 Boom
7 Mast
8 Upper assembly
9 Pivot point
10 Hydraulic cylinders
11 Hose management system
12 Hydraulic cylinders
13 Hydraulic cylinders
14 Hydraulic motor and gearbox arrangement
15 Pinion
16 Turntable
17 Turntable
18 Outer mast tube section
19 Inner mast tube section
20 Slide pads
21 Primary enclosure
22 Quick disconnect plate
23 Locating pins
24 Container
25 Sliding gates
26 Hydraulic cylinder
27 Hose management system
28 Hose reel
23 Process hose
31 Hydraulic motor
32 Float
33 Seal housing
34 Conical interface
35 Sump tank
36 Tangential inlet
37 Inner mast tube section
39 Door
40 hydraulic cylinder
41 slide pads
42 submersible pump
44 drive shaft
45 cable
46 flexible couplings
47 encoder
48 pump shaft
49 discharge piping
51 seals
52 heat exchanger
53 suction hose
54 accumulator
57 outlet FIG. 1 illustrates a large riser extended reach sluicer and tool changer 1 mounted in a nuclear storage tank 3 with optional auxiliary tool in a possible off-center location.

In reference to FIG. 1, the large riser extended reach sluicer and tool changer 1 cleaning system can be mounted in nuclear waste storage tanks through existing pipe tank risers and holes as small as approximately 34-inches in diameter. The large riser extended reach sluicer and tool changer can be constructed to be lightweight, and as such, it can be fully supported by the adapter spool 2 at the tank interface.

The boom can extend in and out and the mast 7 can travel up and down to allow full reach in an approximately 75 foot diameter tank with a waste depth of up to approximately 10 feet. Waste material can be delivered from the end effector 4 located at the end of the boom 6 to a pump assembly 5 situated at the distal end of the mast 7. The pump assembly 5 can then transfer the waste out of the tank. The use of hydraulic power removes any potential ignition sources from electrical components and allows operation in tanks with explosive vapors.

Figure 2A:
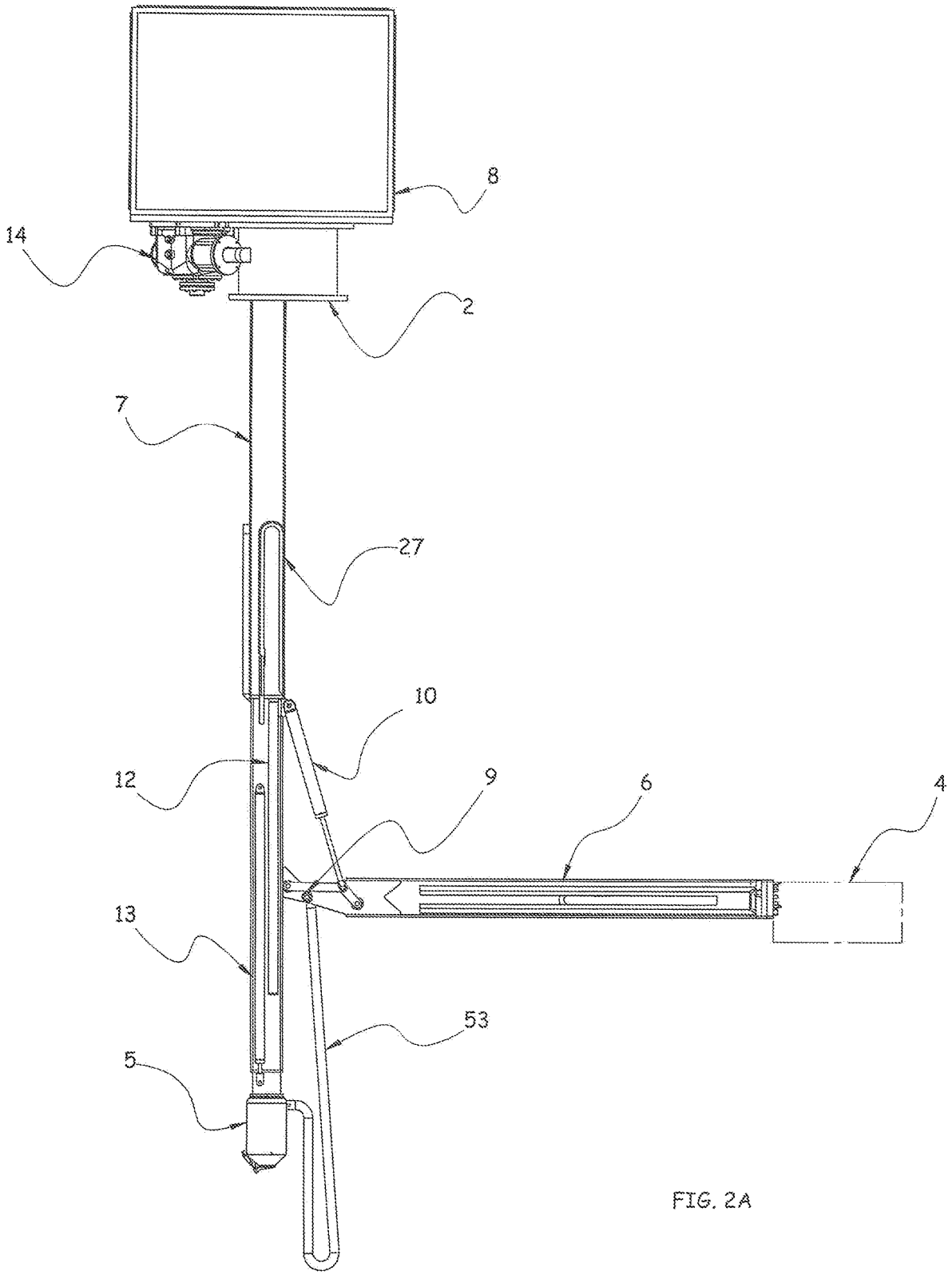
FIG. 2A illustrates a left side view of large riser extended reach sluicer and tool changer of FIG. 1 with the boom horizontal and retracted and the mast fully retracted.
Figure 2B:
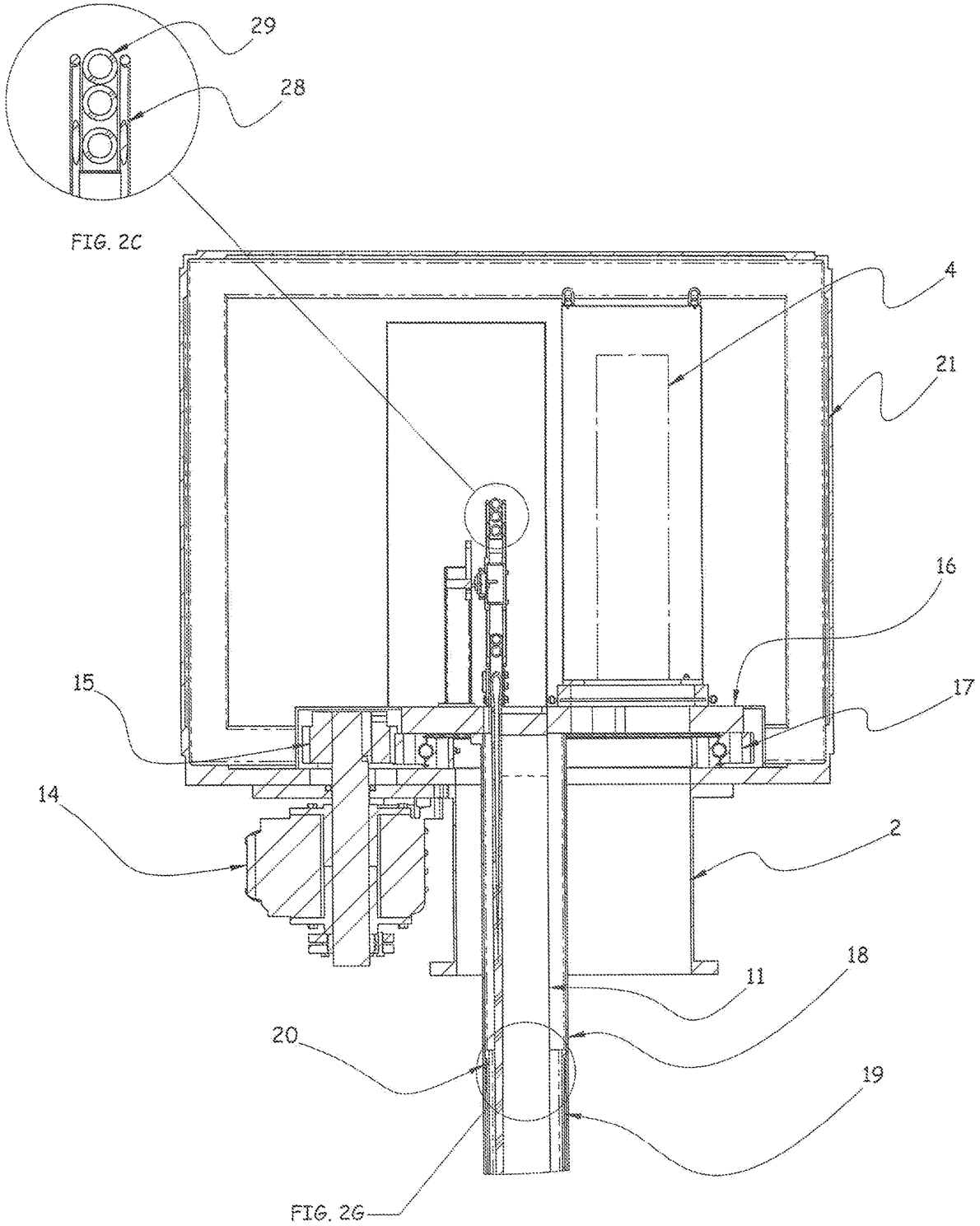
FIG. 2B shows a cross-sectional view of the upper assembly of the large riser extended reach sluicer and tool changer of FIG. 2A.
Figure 2D:
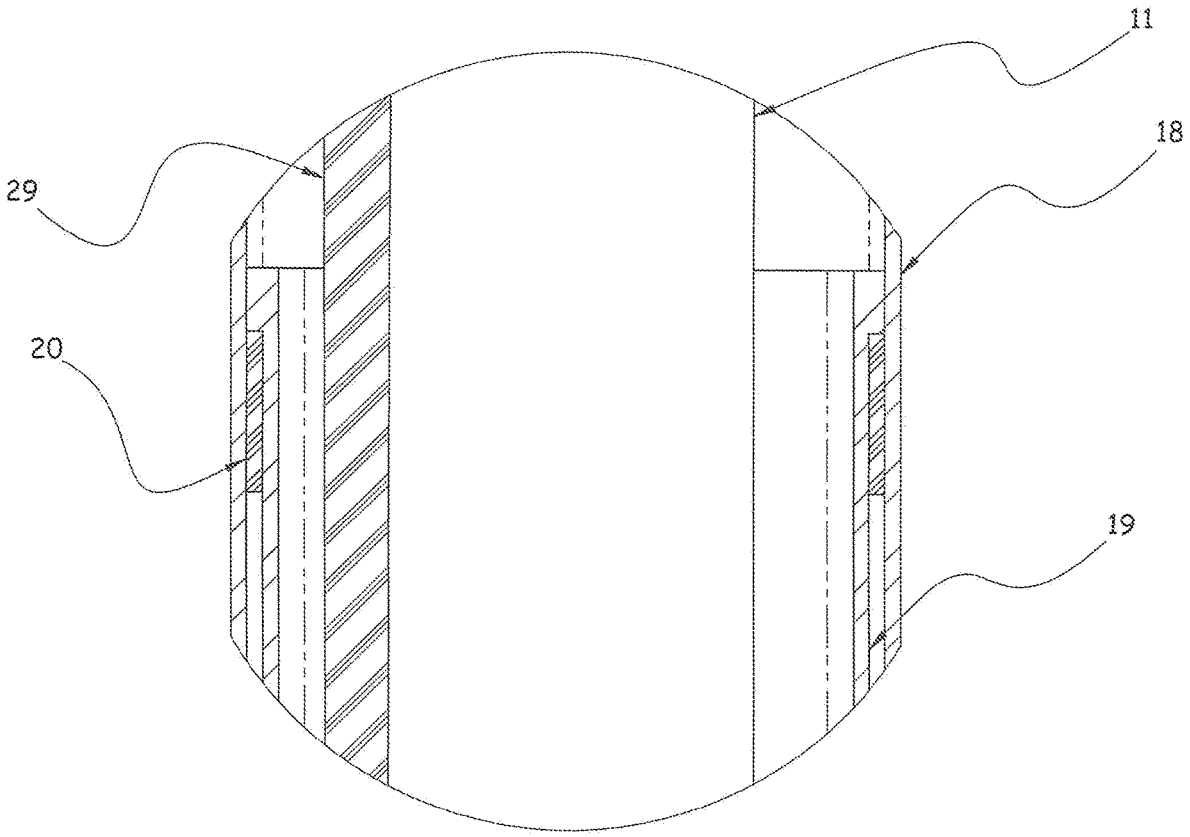
FIG. 2D is a close-up view of the outer and inner mast tube of FIG. 2B

FIG. 2A illustrates a left side view of large riser extended reach sluicer and tool changer 1 of FIG. 1 with the boom 6 horizontal and retracted and the mast 7 fully retracted. FIG. 2B shows a cross-sectional view of the upper assembly 8 of the large riser extended reach sluicer and tool changer 1 of FIG. 2A. FIG. 2C is a close-up view of the process hose 29 and hose reel 28 of FIG. 2B. FIG. 2D is a close-up view of the outer mast tube 18 and inner mast tube 19 of FIG. 2B.

Figure 2E:
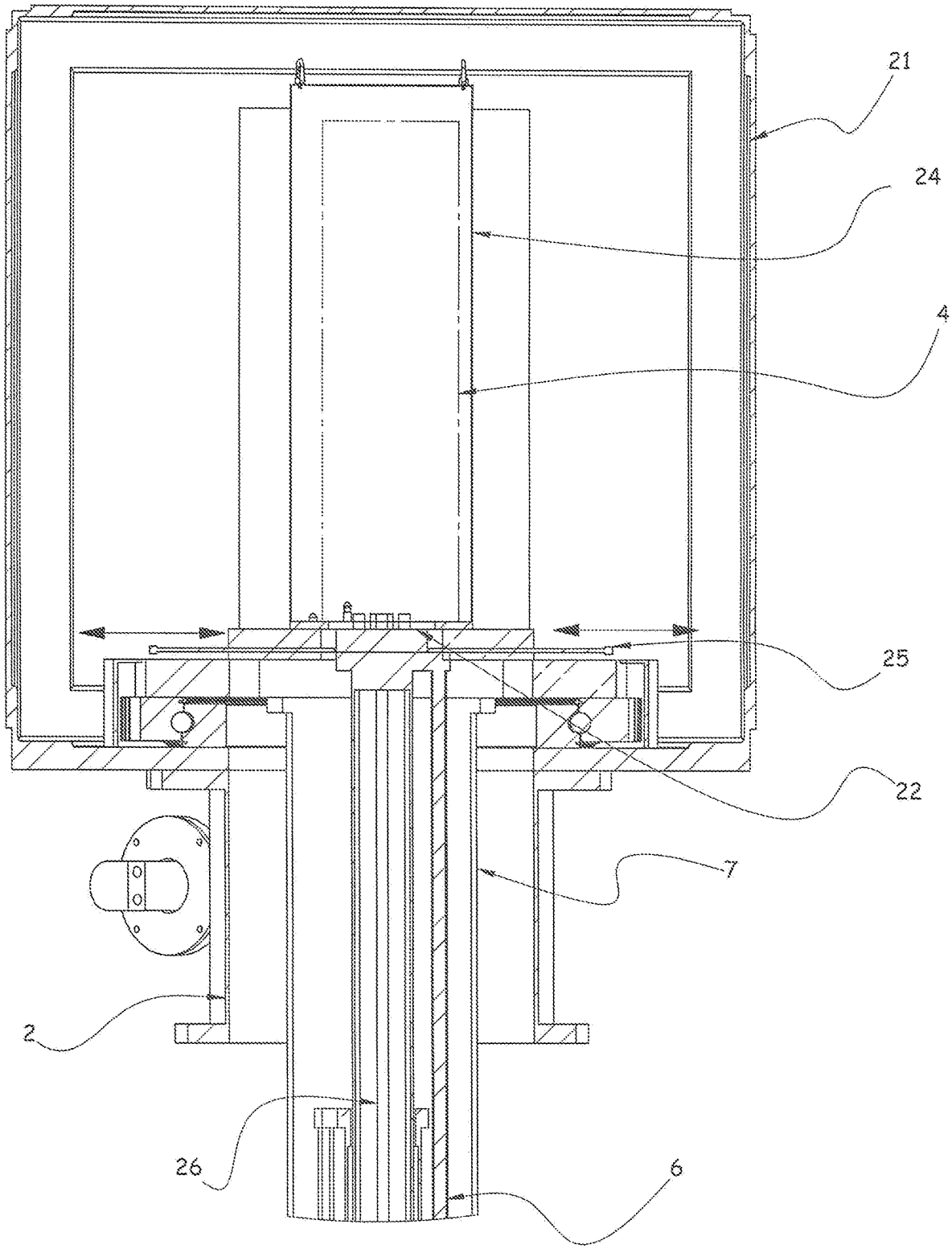
FIG. 2E is an alternative cross-sectional view of the upper assembly of the large riser extended reach sluicer and tool changer of FIG. 2A.

FIG. 2E is an alternate cross-sectional view of the upper assembly of the large riser extended reach sluicer and tool changer 1 of FIG. 2A.

Figure 2F:
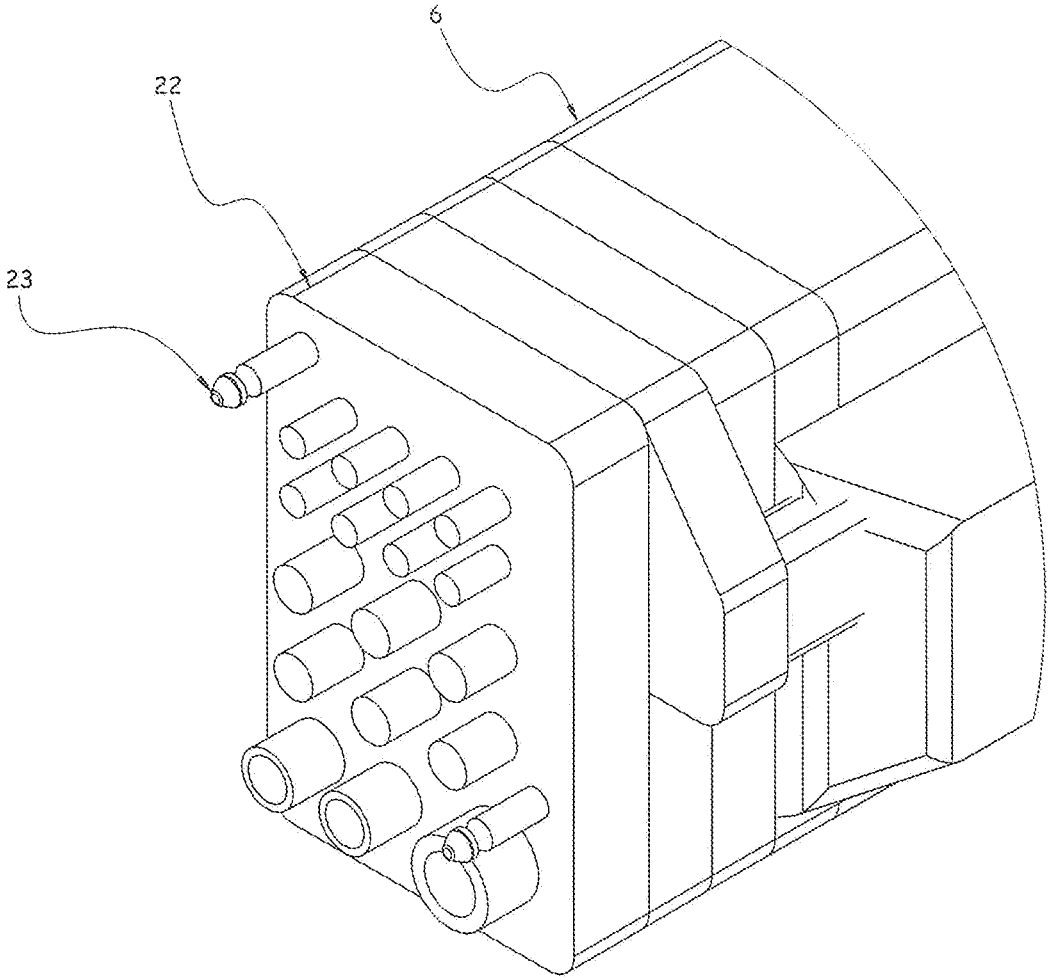
FIG. 2F is an enlarged view of the quick disconnect plate on the distal end of the boom of FIG. 2A.

FIG. 2F is an enlarged view of the quick disconnect plate 22 on the distal end of the boom 6 of FIG. 2A.

In reference to FIGS. 2A, 2B, 2C, 2E and 2F the large riser extended reach sluicer and tool changer cleaning system 1 can comprise an upper assembly 8 that contains a turntable 17 and hose management system 11 comprised of one or more articulating tracks to guide and accommodate the hydraulic hoses through the various stages as they rotate, extend or retract.

A similar hose management system 27 can be used to control the additional length of hydraulic hose running down the mast 7. Running along the inside of the inner most tube can be the process hose 29 that leads to a hose reel 28 in the primary enclosure 21 of the upper assembly 8.

Extending down from the turntable 16, a rectangular mast 7 can be rotated approximately +/−180 degrees about the longitudinal axis through a slew ring 17 driven by a pinion 15 coupled to a hydraulic motor and gearbox arrangement 14.

FIG. 2D depicts an embodiment utilizing a rectangular telescopic mast assembly comprised of an outer mast tube section 18 and an inner mast tube section 19 that can slide past each other lengthwise with slide pads 20 between. Hydraulic cylinders 12 provide the extension and retraction.

Elevation of the boom 6 can be about the pivot point (9) with up to approximately 180 degrees of rotation from the approximate 12 o'clock to the approximate 6 o'clock position. The boom is telescopic and allows extension and retraction to reach radially out over approximately 37 and approximately ½ feet within the perimeter of the tank. Hydraulic cylinders (10) can be used to provide the force for extending and retracting as well as for elevation. The overall range of motion and degrees of freedom can be further extended with the addition of varying end effectors.

In reference to FIG. 2,/ a quick disconnect plate 22 on the distal end of the boom 6 can be comprised of a plurality of circuits for hydraulics, high pressure/low flow water, low pressure/high flow water, supernate, and a suction line for waste conveyance. Locating pins 23 ensure proper alignment between the quick disconnect plate 22 and applicable end effector. Built in compliance allows for minor misalignment during initial engagement. Hydraulically actuated clamps secure the plate where pressure applied disengages the clamps. If pressure is lost, or a hose is damaged, this failsafe mechanism prevents accidental separation of the end effect or from the arm.

FIG. 2E shows the boom 4 at the approximate 12 o'clock position and a hydraulic cylinder 26 extending it up through the adapter spool 2 and into the end effector storage container 24. To reduce environmental exposure, a wash station can rinse the radioactive waste from the end effector prior to entering the containment area.

Once the fouled end effector is secured in the container, the boom 6 lowers, sliding gates 25 separating the containment area from the tank close, and the container 24 can be lifted by hoist and taken away for further processing. A new end effector storage container 24 can then be lowered into place, the sliding gates 25 opened, the boom 6 extended, and a new end effector 4 is engaged and commissioned. The container remains can place for the duration of the operation.

Figure 2G:
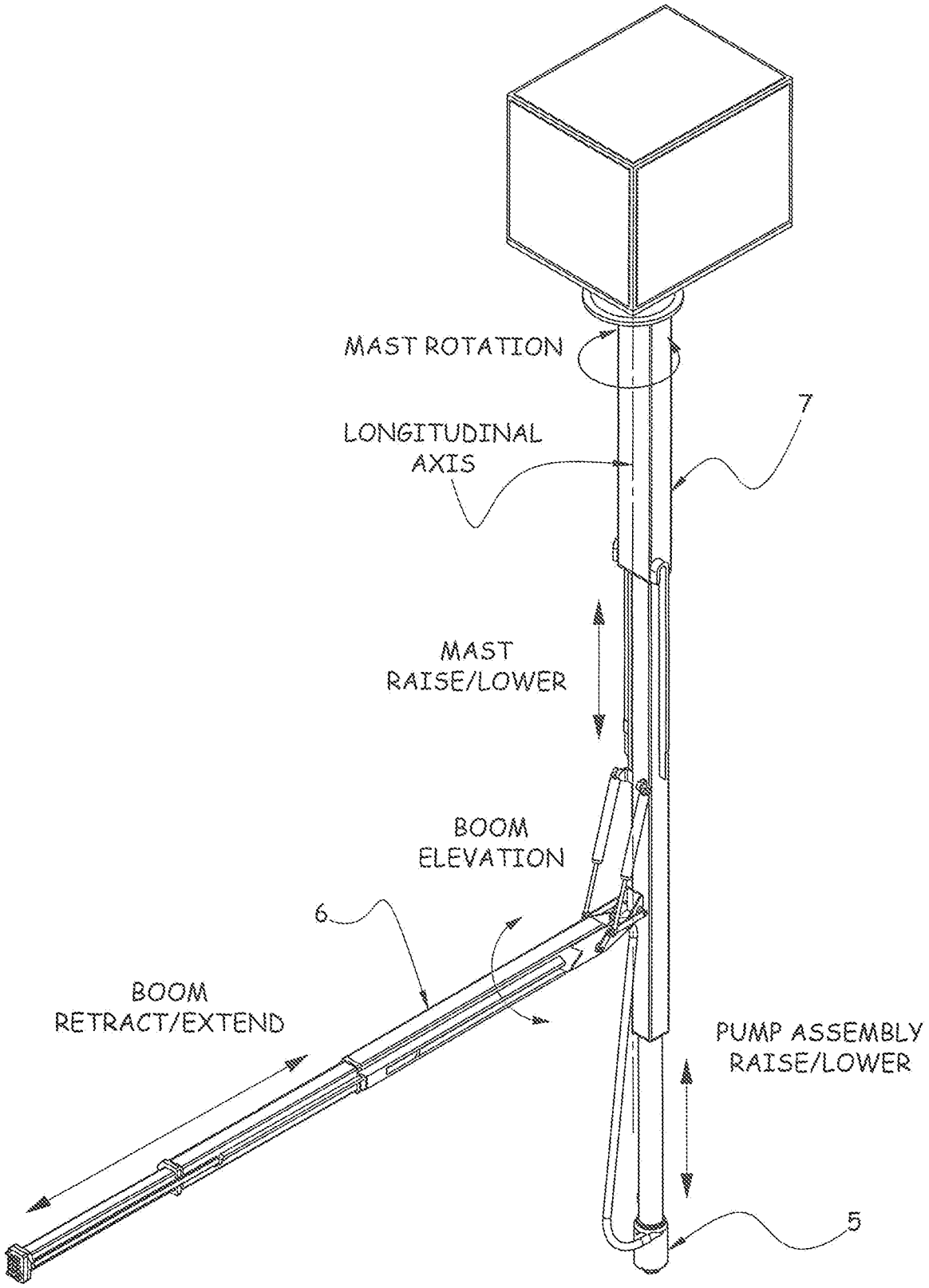
FIG. 2G is a perspective view of the large riser extended reach sluicer and tool changer of FIG. 2A illustrating the ranges of motion.

FIG. 2G is a perspective view of the large riser extended reach sluicer and tool changer 1 of FIG. 2A illustrating the ranges of motion.

Figure 2H:
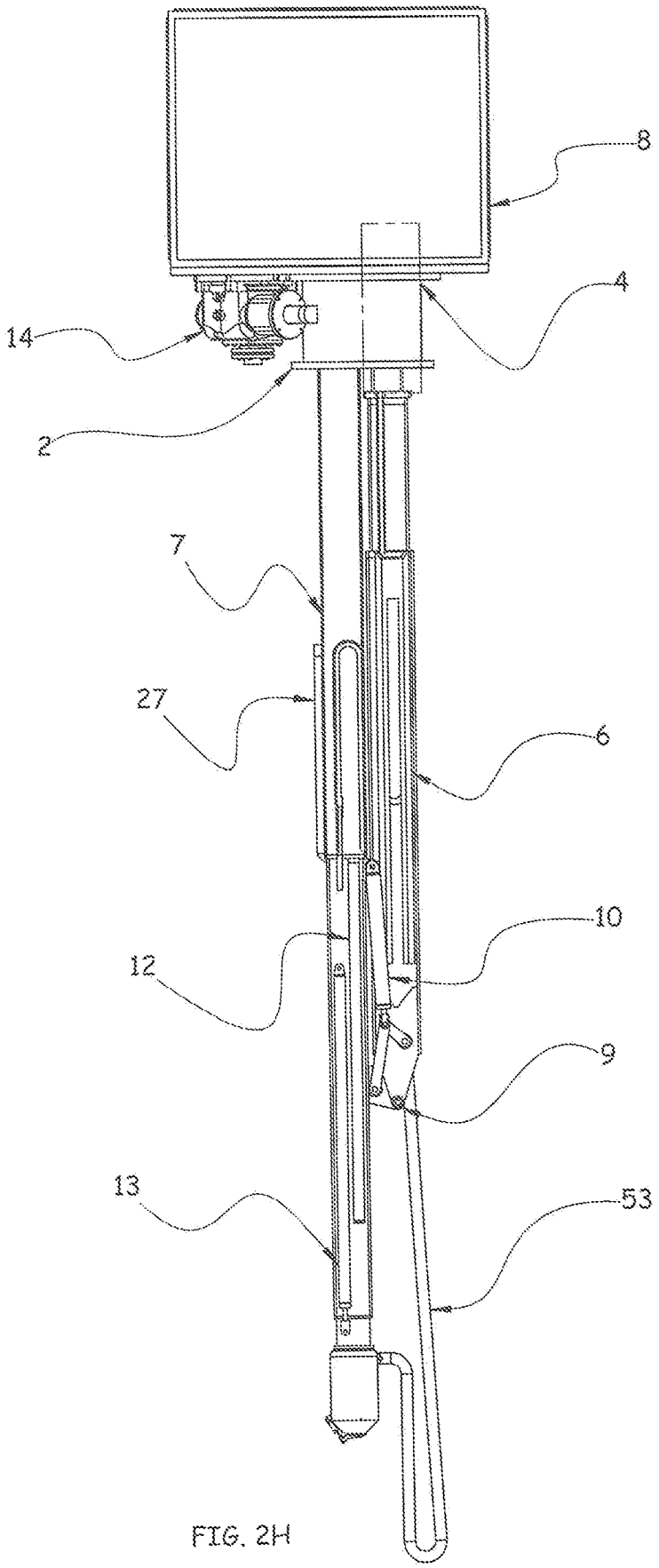
FIG. 2H illustrates the large riser extended reach sluicer and tool changer of FIG. 2A, with the boom in the 12 o'clock position.

FIG. 2H illustrates the large riser extended reach sluicer and tool changer 1 of FIG. 2A, with the boom 6 in the 12 o'clock position. Waste can be transferred through a suction hose 53 running from the end effector 4 to the pump assembly 5.

Figure 3:
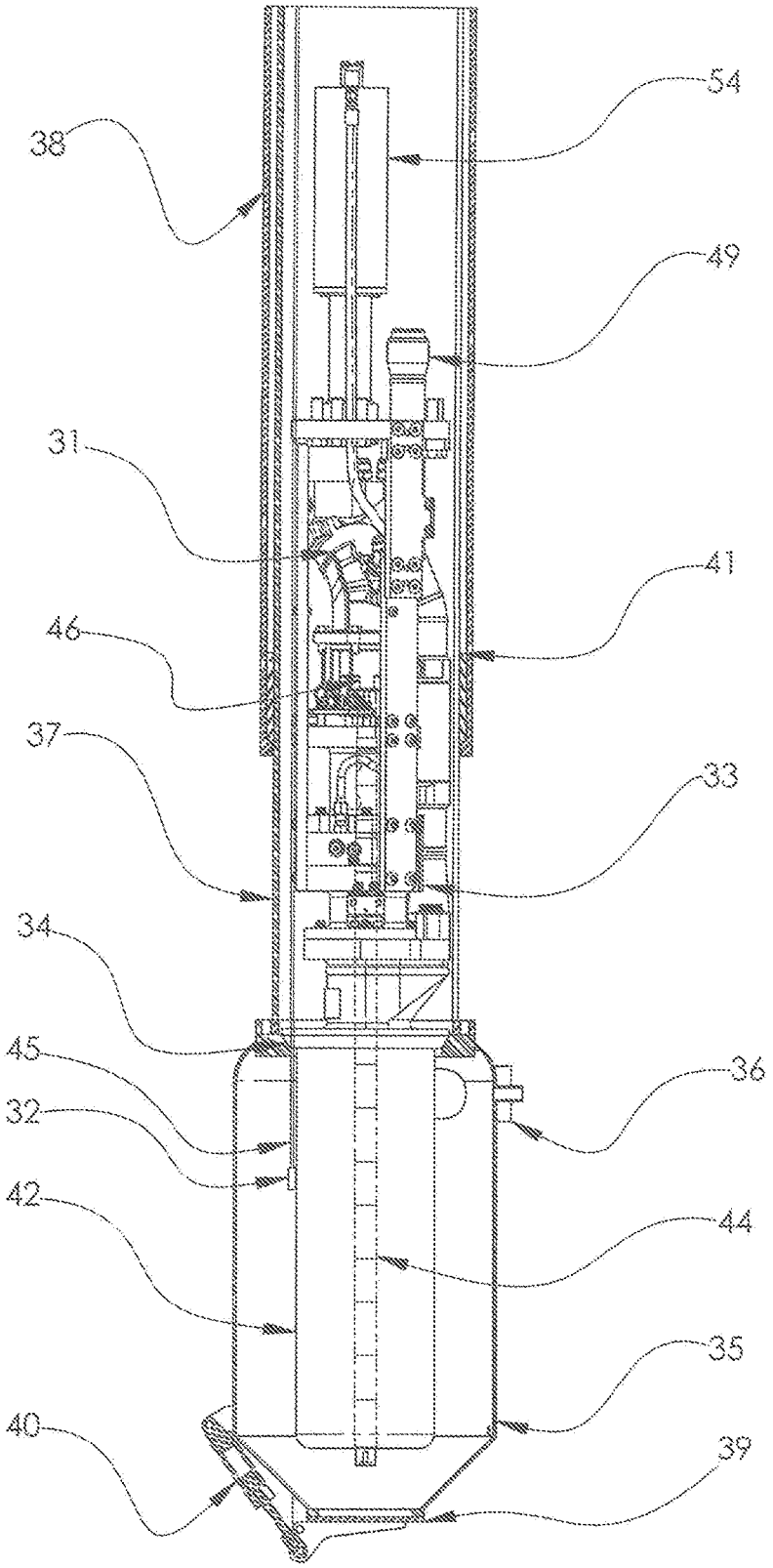
FIG. 3 is a cross-sectional view of the pump assembly of FIG. 2A.

FIG. 3 is a cross-sectional view of the pump assembly 5 of FIG. 2A.

In reference to FIG. 3, the pump assembly 5 can raise and lower independently of the upper mast section 7 to control the relative height between the end effector and the pump inlet, and therefore, reduce the required pressure head required from the end effector. This embodiment can utilize a telescopic mast assembly comprised of an outer mast tube section 7 and an inner mast tube section 37 that can slide past each other lengthwise with slide pads 41 between. Referring back to FIG. 2A, hydraulic cylinders 13 can provide the extension and retraction.

In reference to FIG. 3, the pump assembly 5 can be comprised of a submersible pump 42 driven by a hydraulic motor 31 and is stacked vertically to fit through the mast 7. The pump 42 can be enclosed by a sump tank 35. The conical interface 34 between the pump 42 and the tank 35 allow the pump 42 to be lowered into position and self-align.

Seals can prevent liquid from rising past the interface, into the mast 7, and spilling out into the environment. The wetted components of the pump assembly 5 can be constructed from stainless steel to prevent corrosion and allow for decontamination. Where feasible, 12 point bolts are used to prevent the buildup of hazardous waste.

Figure 4:
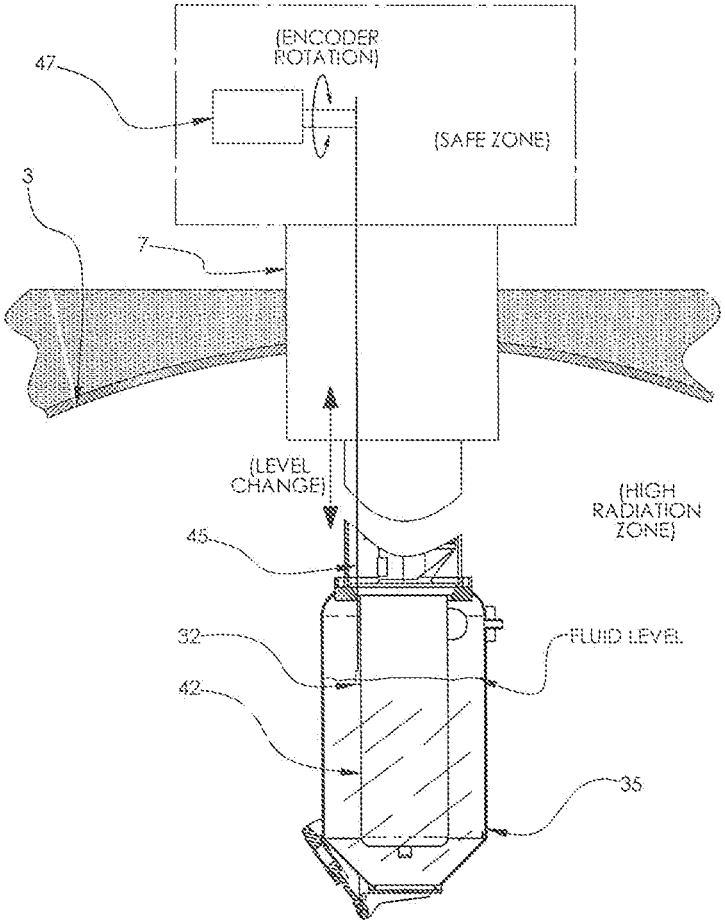
FIG. 4 is diagrammatical view of the level indicator apparatus which is used in FIG. 3.

FIG. 4 is diagrammatical view of the level indicator apparatus 32 which is used in FIG. 3.

In reference to FIG. 4, a level indicator can monitor the fluid level in the sump tank 35. The level indicator can be a float 32 attached to the first end of a cable 45 that travels longitudinally through the pump assembly, through the upper mast 7, and out of the waste tank 3, in order to keep any electronics outside the highly radioactive environment. The second end of the cable attaches to a mechanical device that can rotate an encoder 47. As the level in the sump 35 goes down, gravity will cause the float to travel down, rotating the encoder 47 in one direction. As the level in the sump 35 goes up, the float 32 will travel up, rotating the encoder 47 in the counter direction. The positional information from the encoder 47 can then feedback to a controller as a fluid level.

In an alternate embodiment, the float 32 could be attached to a strain gauge that detects change in force as a float travels up or down. In further embodiments, the level could be measured through pressure transducers or capacitance transducers. The sensors could also be non-contact sensors such as laser, ultrasonic, LED, radar, or any other non-contact sensor that can output an analog signal to a controller. The sensors could be rated for use in hazardous and radioactive environments.

The hydraulic motor 31 can be located above the pump, mounted to the seal housing 33 such that it is separated from the waste stream through seals, thereby eliminating the possibility of nuclear waste contaminating the hydraulic system and reaching outside of the waste tank. In case of a leak at the seals, the seal housing has ports to allow any waste to drain back into the waste tank.

The hydraulic motor 31 and the pump 42 can be coupled through drive shaft 44 and one or more flexible couplings 46.

A door 39 coupled to a hydraulic cylinder 40 on the bottom of the sump tank 35 can swing open to clear debris and allow back flushing of the pump 42.

Figure 5:
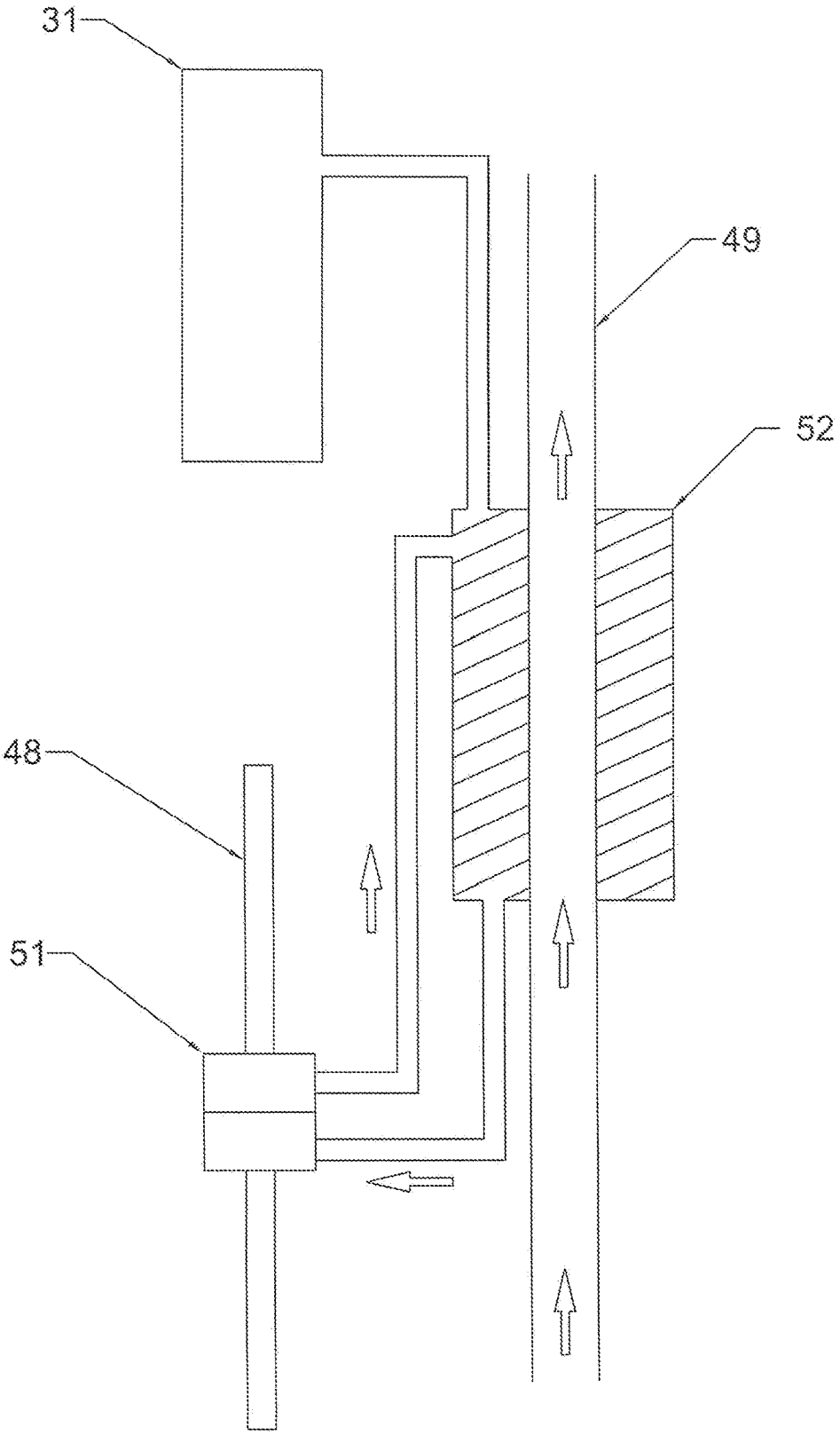
FIG. 5 is a schematic of the barrier fluid recirculation, cooling circuit used in FIG. 2A.

FIG. 5 is a schematic of the barrier fluid recirculation, cooling circuit used in FIG. 2A.

In reference to FIG. 5, the seals 51 coupled to the pump shaft 49 can contain a barrier fluid at the seal faces to reduce heat from friction and reduce wear on the seals. The barrier fluid can be circulated around the seals 51 and cooled through a barrier fluid heat exchanger 52 to improve the performance and increase the life of the seals. The heat exchanger 52 can be comprised of a helical path traversing the outside diameter of the discharge piping 49. An accumulator 54 self-compensates for changes in the barrier fluid due to temperature and/or pressure.

Figure 6:
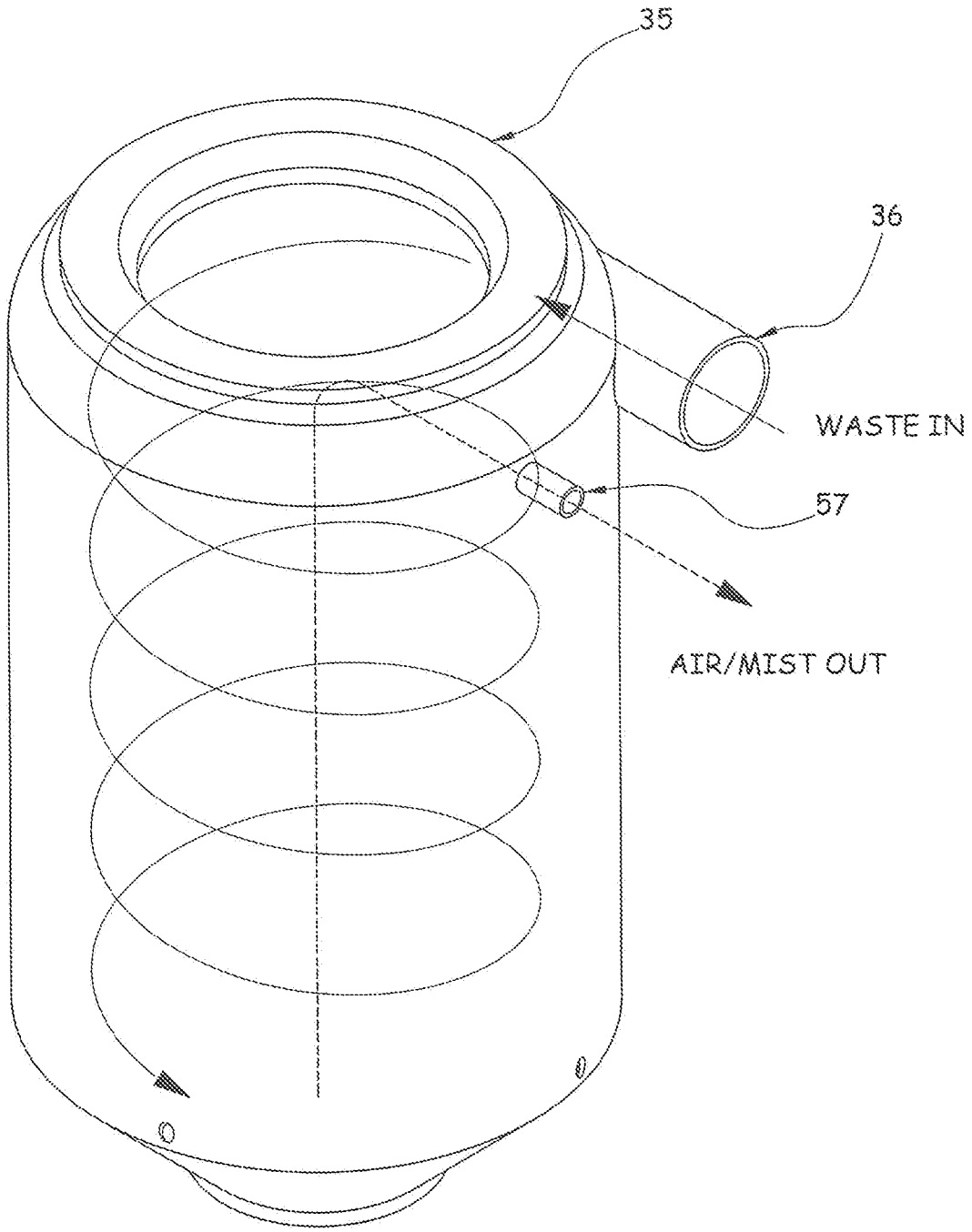
FIG. 6 is a diagram illustrating the tangential inlet at the sump tank of FIG. 2A.

FIG. 6 is a diagram illustrating the tangential inlet at the sump tank of FIG. 2A.

As shown in FIG. 6, a tangential inlet 36 to the sump tank 35 can promote the separation of entrained air from the liquid. This process can also generate mist that would render visibility impossible if vented back into the tank, so a hose connection between an outlet 57 at the top of the sump tank and the suction inlet at the end effector allows for recirculation of the mist.

The large riser extended reach sluicer and tool changer hydraulic power unit can be comprised of a skid mounted pumping system that delivers hydraulic fluid to a manifold system utilizing adjustable electro-hydraulic valves. From up to approximately 1000 feet away, operation of the system is achieved through a remote control station containing pushbuttons, switches, and joysticks.

The pump hydraulic power unit can be comprised of a skid mounted pumping system that delivers hydraulic fluid to the pump hydraulic motor 31 of FIG. 3. The hydraulic supply pump can be displacement limited by a mechanical stop so that the nuclear waste pump hydraulic motor cannot over pressurize the discharge piping, thus keeping the system within safe operating conditions and preventing environmental contamination from piping failures.

The terms "approximately"/"approximate" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A large riser extended reach sluicer and tool changer comprising: a vertically adjustable upper mast section that mounts to existing riser structures of a waste tank approximately 34 inches in diameter; a movable cleaning boom arm having one end attached to the mast section and an opposite end with a changeable end effector; a nuclear waste pump system on a distal end of the upper mast section, comprising: a submersible pump assembly that fits through an upper mast; and a hydraulically driven pump motor for high power density and for safe operation in areas in the waste tank with hazardous/explosive vapors; a level indicator; wetted parts constructed of stainless steel to allow for decontamination; a hydraulic power unit with displacement limiting features to keep system pressures in a safe operating range; one or more seals that prevent a waste stream from contaminating a hydraulic fluid; one or more seals with recirculating barrier fluid that is cooled through a heat exchanger comprised of a helical path traversing the outside diameter of a discharge piping; an accumulator to compensate for changes in barrier fluid pressure and temperature; and a sump tank housing a pump mounted at a distal end of a telescoping mast.

2. The large riser extended reach sluicer and tool changer of claim 1, further comprising: a plurality of hose management systems that accommodate axial and radial motion of the movable cleaning boom arm.

3. The large riser extended reach sluicer and tool changer of claim 1, wherein the upper mast section includes: a plurality of hydraulically actuated cylinders and motors allowing operation in hazardous and explosive environments.

4. The large riser extended reach sluicer and tool changer of claim 1, wherein the upper mast section includes: a mast assembly attached to a turntable that rotates the movable cleaning boom arm +/− approximately 180 degrees.

5. The large riser extended reach sluicer and tool changer of claim 1, wherein the moveable boom cleaning arm includes: a telescoping boom that pivots approximately 180 degrees from vertical to horizontal and extends beyond approximately 37 and ½ feet.

6. The large riser extended reach sluicer and tool changer of claim 1, wherein the moveable cleaning boom arm includes: a telescoping boom that when in an approximate 12 o'clock position is extendable up through the riser and stow the changeable end effector in a storage container.

7. The large riser extended reach sluicer and tool changer of claim 1, wherein the moveable cleaning boom arm includes: a telescoping boom that when in an approximate 12 o'clock position is extendable up through the riser and pick the changeable end effector from a storage container to be commissioned in the waste tank.

8. The large riser extended reach sluicer and tool changer of claim 1, further comprising: one or more sliding gates at a containment interface of the changeable end effector to shield the environment from radiation.

9. The large riser extended reach sluicer and tool changer of claim 8, further comprising: a wash station prior to the sliding gates at the containment area interface.

10. The large riser extended reach sluicer and tool changer of claim 1, further comprising: a quick disconnect plate mounted at a distal end of the movable cleaning boom arm with the ability to mate with and support varying end effectors for use in the waste tank.

11. The large riser extended reach sluicer and tool changer of claim 1, further comprising: a quick disconnect plate with circuits for hydraulics, high pressure and low flow water, low pressure and high flow water, supernate, and a suction line for waste conveyance as needed by varying end effectors.

12. The large riser extended reach sluicer and tool changer of claim 1, further comprising: a failsafe that includes a quick disconnect plate with hydraulically actuated clamps where pressure applied disengages the clamps so that if pressure is lost, or a hose is damaged, the changeable end effector remains secured to the quick disconnect plate such that the changeable end effector cannot become separated from the movable cleaning boom arm and dropped into the waste tank.

13. The large riser extended reach sluicer and tool changer of claim 1, further comprising: a container for housing radioactive end effectors and which prevents radiation from leaking into the environment.

14. The large riser extended reach sluicer and tool changer of claim 1, further comprising: nickel plating on wetted mechanical structures in the tool changer to counteract corrosive environments.

15. The large riser extended reach sluicer and tool changer of claim 1, further comprising: a total service weight that is able to be supported by a tank dome and riser structure; a capability to clean inside, behind, on top, below and around obstructions in tanks; a number of degrees of freedom up to 5 or more; operable capability during the course of a tank cleaning campaign without the need for service; and an extended reach to allow the changeable end effector to get closer to a work surface over a larger area.

16. The large riser extended reach sluicer and tool changer of claim 1, further comprising: a manifold system for a supply/return of working hydraulic fluid utilizing adjustable electro-hydraulic valves allowing control of the manifold system from up to approximately 1000 feet away.

17. The large riser extended reach sluicer and tool changer of claim 1, wherein the sump tank housing includes one of: a conical seat to allow self-alignment of the pump during installation through the mast, and a conical pump seat that creates a seal to prevent waste material from overfilling into and through the mast.

18. The large riser extended reach Sluicer and tool changer of claim 1, wherein the sump tank housing includes one of: a sump tank with a tangential inlet to allow for air separation, and a sump tank with an outlet port to allow for mist recirculation such that no mist is discharged into the waste tank that would compromise visibility.

19. The large riser extended reach sluicer and tool changer of claim 1, wherein the sump tank housing includes: a sump tank with a hydraulically actuated door at the bottom to clear debris and allow back flushing of the pump.

* * * * *